US006251252B1

(12) United States Patent
Chen

(10) Patent No.: US 6,251,252 B1
(45) Date of Patent: Jun. 26, 2001

(54) METALIZATION OF NON-HERMETIC OPTICAL FIBERS

(75) Inventor: Meijiao Sara Chen, Annapolis, MD (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/383,578

(22) Filed: Aug. 25, 1999

Related U.S. Application Data

(60) Provisional application No. 60/097,772, filed on Aug. 25, 1998.

(51) Int. Cl.[7] ..... C25D 5/54; C25D 7/00; C23C 28/02

(52) U.S. Cl. ..... 205/163; 205/149; 205/187

(58) Field of Search ..... 205/149, 163, 205/187

(56) References Cited

U.S. PATENT DOCUMENTS 5,380,559 * 1/1995 Filas et al. ..... 427/305
5,774,615 * 6/1998 Uda et al. ..... 385/128

* cited by examiner

*Primary Examiner*—Edna Wong

(57) ABSTRACT

The present invention provides a simple, reproducible electroless process for metalizing a non-hermetic optical fiber. The process of the present invention provides the optical fiber with a metalization layer suitable for solder bonding the optical fibers to other surfaces. The silica surface of the optical fiber is sensitized with a stannous fluoride solution, catalyzed with a catalyzing solution of stannous chloride and hydrochloric acid, and activated with an activator solution comprising palladium chloride. The sensitizing, catalyzing and activating steps are performed under ambient condition. Then nickel is plated on the silica surface through electroless plating and electrolytic plating. Finally, a gold layer is plated on the nickel layer. The process produces good adhesion properties and reliable optical fiber attachment for various applications.

9 Claims, 1 Drawing Sheet

TYPICAL NON-HERMETIC USED IN METALIZATION:

METALIZATION OF NON-HERMETIC OPTICAL FIBERS

RELATED APPLICATIONS

The subject application claims the priority of U.S. provisional applications No. 60/097,772, entitled "Metalization of Non-hermetic Fibers," filed on Aug. 25, 1998.

FIELD OF THE INVENTION

The present invention relates generally to metalization of an optical fiber. More particularly, the invention relates to metalization of non-hermetic optical fiber pigtails that are used in the Bragg grated optical industry.

BACKGROUND OF THE INVENTION

Optical fibers have been widely used for industrial communication systems. In optical devices such as lasers, photodetectors, feedthroughs and sensors, the optical fiber and other device components need to be joined. As a requisite step, the optical fiber needs to be first metalized. There exist several techniques in the prior art for metalization of the optical fibers. A conventional approach is to use a vacuum deposition technique such as sputtering. A metal layer is sputtered onto the optical fiber. The metal used for sputtering deposition includes titanium, platinum and gold. The sputtered metal has relatively good adhesion properties on the optical fiber. However, this approach is not only expensive but also produces a non-uniform coating. It also tends to weaken the optical fiber and puts limitations on the type of polymeric jacket that can be used in the vacuum of the sputtering chamber.

Another technique has been used in the past is electroless deposition of nickel to metalize the glass surface of the optical fiber. A glass surface of the optical fiber is prepared for the electroless deposition of nickel by applying onto the surface a sensitizer which acts to deposit a catalyst for the nickel reduction from an electroless nickel plating solution. U.S. Pat. No. 5,380,559 to Filas et al. discloses an electroless process to deposit nickel and gold onto an optical fiber using aqueous chemistry. The key to the process is a sensitization of the surface of the optical fiber using a dilute aqueous stannous fluoride solution in absence of oxygen. Stannous fluoride solution is prepared by dissolving crystalline $SnF_2$ in deionized water. Subsequent treatment includes immersion of sensitized optical fiber in a palladium chloride/HCl aqueous solution and commercially available electroless nickel and electroless gold solutions. Although it is possible to obtain reproducible plating of nickel on the surface of the optical fiber according to this approach, it is inconvenient and put a lot of restrictions on the process condition because the majority of process steps need to be performed in absence of oxygen. Thus, a simple and yet reproducible process for the electroless metalization of optical fibers is needed.

SUMMARY OF INVENTION

A method for metalizing a non-hermetic optical fiber having a bare silica surface is disclosed. According to the present invention, the method comprises the steps in the following order. The silica surface is sensitized with a stannous fluoride solution having a concentration of 0.1% by weight under ambient condition. The sensitized silica surface is catalyzed with a catalyzing solution comprising stannous chloride and hydrochloric acid under ambient condition. Then the catalyzed silica surface is activated with an activator solution comprising palladium chloride under ambient condition. A first nickel layer is deposited on the activated silica surface by immersing into an electroless nickel plating solution, and a second nickel layer is also deposited by immersing into an electrolytic nickel plating solution. Finally, a gold layer is deposited on the nickel layer by immersing into an electrolytic gold plating solution.

Preferably, the sensitizing step is conducted in the stannous fluoride solution at a temperature of 72 F. for 5 minutes. The catalyzing solution comprises 14.26% of Shipley Co.'s Sensitizer 471solution, and the activating solution comprises 5% of Shipley Co.'s Activator 472 solution. The electroless nickel plating solution has 1 part of sodium fluoride, 80 parts of sodium succinate, 100 parts of nickel sulfate and 169 parts of sodium hyprophosphite with 500 parts of deionized water. The temperature of the electroless nickel plating solution is about 130 F. The nickel deposition rate in the electroless nickel plating is about 1 $\mu$m per ½ hour. The electrolytic nickel solution has 13 ounce/gallon nickel with pH between 3.5 to 4.5. The electrolytic gold plating solution has 0.5 Troy ounce/gal and pH of 4.0 to 4.8.

BRIEF DESCRIPTION OF THE DRAWINGS

These and other objects, features and elements of the present invention will be better understood from the following detailed description of preferred embodiments of the invention in which.

DESCRIPTION OF THE PREFERRED EMBODIMENTS

Figure 1:
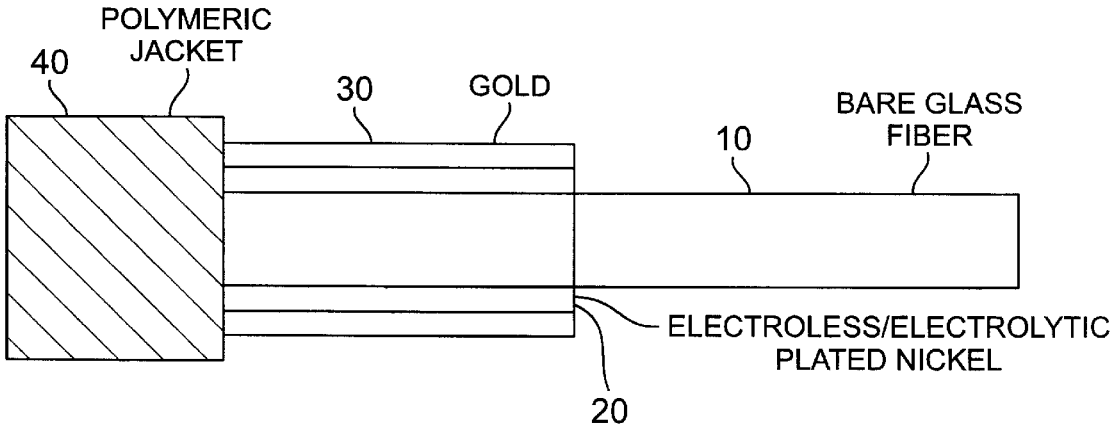
FIG. 1 is a schematic illustration of a non-hermetic optical fiber after metalization.

The present invention provides a simple, reproducible electroless process for metalizing a non-hermetic optical fiber. The process of the present invention provides the optical fiber with a metalization layer suitable for solder bonding the optical fibers to other surfaces. FIG. 1 is a schematic illustration of a metalized optical fiber. The metalized optical fiber comprises a bare portion of a glass optical fiber 10, an electroless/electrolytic plated nickel layer 20 on the bare portion of the glass optical fiber, a gold layer 30 on the nickel layer, and a coating layer 40 on remaining portion of the glass optical fiber which is not subjected to metalization.

In general, the metalization process of the present invention comprises a step of fiber preparation and a step of plating. These steps are now described in detail as follows.

To prepare the optical fiber for metalization, a preselected length of the coating layer such as a polymeric jacket is removed to expose the optical fiber. Various methods can be used for this purpose. The most frequently used methods are mechanical stripping and chemical decomposition. In a preferred embodiment of the present invention, a mechanical stripping is used to remove the coating layer of the optical fiber. The coating layer of the optical fiber is cleaved and removed to expose a length of the optical fiber to be metalized. In case of a polymeric jacket as the coating layer, the cleaved layer is stripped with a Miller stripper.

Once the cleaved coating layer is removed, the stripped portion of the optical fiber is subjected to a chemical stripping. This is carried out by immersing the exposed portion of the optical fiber into a methylene chloride or equivalent solution to chemically dissolve or strip away any polymeric residues on the surface of the optical fiber. The chemical stripping is performed at ambient condition for 20–30 seconds. The methylene chloride solution used for the chemical stripping is one of commercially available products. The optical fiber is then dipped into a deionized water reservoir or rinsed by a deionized water stream to remove any chemical solution remained on the exposed portion of the optical fiber.

The silica surface of the optical fiber is then sensitized to promote its surface sensitivity in subsequent plating steps. The optical fiber is immersed in a stannous ($SnF_2$) solution. The stannous fluoride solution has a concentration of 0.1% by weight. It is preferred that the sensitizing step is conducted in the stannous fluoride solution having a temperature of 72 F. under ambient condition for 5 minutes. Although the sensitizing step of the present invention is not required to be conducted under chemical hood, it is advisable for safety considerations. The treated portion of the optical fiber is cleaned by deionized water to remove any chemical solution before the next process step of the present invention. Note that at the end of each of the following step of process, the optical fiber is always cleaned by deionized water before the next step of process is performed.

The exposed optical fiber surface is catalyzed by immersing it in a sensitizer solution at ambient condition. The sensitizer solution can be obtained from any commercially available sensitizer solution. The sensitizer solution in the preferred embodiment comprises stannous chloride, deionized water and 5% hydrochloric acid. The stannous chloride is provided through the use of Shipley Co.'s Sensitizer 471solution. This sensitizer solution has about 14.26% of Shipley's Sensitizer 471 by volume. This step of process typically takes a duration of time of about 3 minutes.

The exposed portion of the optical fiber is further activated with an activator solution at ambient condition. The activator solution comprises palladium chloride. Likewise, the palladium chloride in the activator solution can be obtained from any commercially available activator solution such as Shipley Co.'s Activator 472 solution. The activator solution in the preferred embodiment comprises the Shipley 472 sensitizer solution. This activator solution has about 5% of the Shipley 472 activator solution by volume, and this step of process typically takes a duration of time of another 3 minutes. In the present invention, there is no need to remove the presence of oxygen during the process.

The exposed portion of the optical fiber is now plated. Before the plating process, the portion of the optical fiber that is not intended for plating is masked so as to shield the nickel deposition. The masking step is carried out with commercially obtainable and ready to use MicroStop solution for 10 seconds. In order to bond nickel to the optical fiber surface, the pre-treated fiber undergoes an electroless plating process for a predetermined period of time. Electroless solution is prepared by adding 1 part of sodium fluoride, 80 parts of sodium succinate, 100 parts of nickel sulfate and 169 parts of sodium hyprophosphite with 500 parts of deionized water. The electroless plating process of the optical fiber is at a solution temperature of about 130 F. A typical plating rate is about 1 $\mu$m per ½ hour. Electroless plated nickel has a thickness of 1.5 $\mu$m.

Then the optical fiber was plated in an electrolytic nickel solution for further adhesion and corrosion resistance. The electrolytic nickel solution has 13 ounce/gallon nickel with pH between 3.5 to 4.5, which is commercially obtainable through Technic Inc. Typical nickel thickness from the electrolytic plating is around 3±0.5 $\mu$m for many applications.

As a final step, the optical fiber is plated with gold in an electrolytic gold solution to provide an excellent corrosion resistance film. The gold serves as a soldering flux in many applications. In a preferred embodiment, the electrolytic gold solution is an Orotherm HT® 0.5 Troy ounce/gal and pH of 4.0 to 4.8, which is also commercially obtainable from Technic Inc. The thickness of the gold plating application depends on various factors. Typical thickness of gold is about 3±0.5 $\mu$m on the application.

The various steps of the metalization process according to the present invention are summarized below in Table 1. It is noted that except for the MicroStop step, each chemical treating step is followed by a deionized water rinse.

TABLE 1

| Bath (Plating steps) | Temperature (F) | Amperage (A) | Time (min.) |
|---|---|---|---|
| Stannous Fluoride | 72 | — | 5 |
| Sensitizer | 72 | — | 3 |
| Activator | Ambient | — | 3 |
| MicroStop | Ambient | — | 10 seconds |
| Electroless Nickel | set point 130 (actual 50 C./122 F.) | — | Dependent on the thickness of Nickel (~1 um per ½ hour) |
| Electrolytic Nickel | 108 | 0.1–0.15 | 10–30 |
| Electrolytic Gold | 108 | 0.1–0.15 | 10–30 |

When conducting the plating process, measurement to the metalized portion of the optical fiber is carried out to monitor the plating thickness. Various conventional measuring devices, such as a Keyence laser micrometer, can be used to ensure the specifications. Note that solution level should be higher than an electroless nickel gauge pin for the following baths: activator, sensitizer, and stannous fluoride. In a preferred embodiment of the present invention, metalized segment's dimensions are as follows:

Thickness for electroless nickel: 1.5±0.5 $\mu$m

Thickness for electrolytic nickel: 3.0±1.5 $\mu$m

Thickness for electrolytic gold: 3.0±1.5 $\mu$m.

The metalized optical fiber is then tested for its adhesion property. The metalized portion of the optical fiber is fluxed and tinned. The optical fiber is then soldered with a 63/37 tin/lead solder to a fixture for tensile testing. The optical fiber is pulled to test when the deposited metal starts to separate from the optical fiber. The separating force is calculated as force/length of the exposed optical fiber. The adhesion result is normalized per ¼ inch length. It is found that typical adhesion results for the optical fiber metalized through the metalization process of the present invention are 3 to 10 lbs.

While the present invention has been described in a number of different exemplary embodiments, it will be understood that the principles of the invention can be extended to still further embodiments and that the embodiments illustrated here are not intended to limit the scope of the invention as set forth in the appended claims.

What is claimed is:

1. A method for metallizing a non-hermetic optical fiber having a bared silica surface, said method comprising the steps in the following order:

sensitizing said silica surface with a stannous fluoride solution having a concentration of 0.1% by weight under ambient condition;

catalyzing said sensitized silica surface with a catalyzing solution comprising stannous chloride and hydrochloric acid under ambient condition;

activating said catalyzed silica surface with an activator solution comprising palladium chloride under ambient condition;

depositing a first nickel layer on said activated silica surface by immersing into an electroless nickel plating solution;

electrodepositing a second nickel layer on said first nickel layer by immersing into an electrolytic nickel plating solution; and electrodepositing a gold layer on said second nickel layer by immersing into an electrolytic gold plating solution.

2. The method for metalizing a non-hermetic optical fiber according to claim 1, wherein said sensitizing step is conducted in said stannous fluoride solution at a temperature of 72 F.

3. The method for metalizing a non-hermetic optical fiber according to claim 2, wherein said sensitizing step is conducted for 5 minutes.

4. The method for metallizing a non-hermetic optical fiber according to claim 1, wherein said catalyzing solution comprises stannous chloride, deionized water and 5% hydrochloric acid.

5. The method for metallizing a non-hermetic optical fiber according to claim 1, wherein said electroless nickel plating solution has 1 part sodium fluoride, 80 parts of sodium succinate, 100 parts of nickel sulfate and 169 parts of sodium hyprophosphite with 500 parts of deionized water.

6. The method for metalizing a non-hermetic optical fiber according to claim 5, wherein said electroless nickel plating solution has a solution temperature of about 130 F.

7. The method for metalizing a non-hermetic optical fiber according to claim 6, wherein nickel deposition rate in said electroless nickel plating is about 1 $\mu$m per ½ hour.

8. The method for metalizing a non-hermetic optical fiber according to claim 1, wherein said electrolytic nickel solution has 13 ounce/gallon nickel with pH between 3.5 to 4.5.

9. The method for metalizing a non-hermetic optical fiber according to claim 1, wherein said electrolytic gold plating solution has 0.5 Troy ounce/gal and pH of 4.0 to 4.8.

* * * * *